US008408952B2

(12) United States Patent
Wu

(10) Patent No.: US 8,408,952 B2
(45) Date of Patent: Apr. 2, 2013

(54) WIRING TERMINAL STRUCTURES

(76) Inventor: Shang Tsai Wu, New Taipei (TW)

( * ) Notice: Subject to any disclaimer, the term of this patent is extended or adjusted under 35 U.S.C. 154(b) by 190 days.

(21) Appl. No.: 13/111,356

(22) Filed: May 19, 2011

(65) Prior Publication Data

US 2012/0295495 A1 Nov. 22, 2012

(51) Int. Cl.
*H01R 4/48* (2006.01)

(52) U.S. Cl. ..... 439/861; 439/441; 439/709

(58) Field of Classification Search ..... 439/861, 439/862, 850, 828, 835, 527, 709, 441
See application file for complete search history.

(56) References Cited

U.S. PATENT DOCUMENTS

| | | | | |
|---|---|---|---|---|
| 7,462,076 | B2 * | 12/2008 | Walter et al. | 439/709 |
| 7,544,103 | B2 * | 6/2009 | Walter et al. | 439/709 |
| 7,927,132 | B1 * | 4/2011 | Lin | 439/527 |
| 8,251,738 | B2 * | 8/2012 | Heckert et al. | 439/441 |

* cited by examiner

*Primary Examiner* — Hae Moon Hyeon
(74) *Attorney, Agent, or Firm* — Muncy, Geissler, Olds & Lowe, PLLC

(57) ABSTRACT

A wiring terminal structure of the present invention includes a box and a plugging element. The box is an integrally formed unitary unit and includes an upper wall, side walls, a lower wall, a hole, and a leaf spring. The upper wall, the side walls, and the lower wall define a space. The hole is formed on the upper wall and enables communication between the space and the outside of the box. The leaf spring extends upward from the lower wall to reach the space and forms an end protruding from the hole. The plugging element includes a plugging portion and a clamping portion having upper and lower clamping leaf springs. The plugging portion is inserted into the space and plugged into the box. The end of the leaf spring abuts against the plugging portion and is pressed downward by the plugging portion to lie in the space.

4 Claims, 6 Drawing Sheets

WIRING TERMINAL STRUCTURES

BACKGROUND OF THE INVENTION

1. Field of the Invention

The present invention relates to wiring terminal structures, and more particularly, to a wiring terminal structure that features enhanced overall structural strength and an enhanced clamping force of a leaf spring.

2. Description of the Prior Art

Normally, a wiring operation of a transmission line is often performed between different electronic elements of an electronic product so as to enable electrical connection and signal transmission between the different electronic elements.

To achieve a wiring purpose, a wiring terminal is usually required. Referring to FIG. 1, there is shown a perspective view of a conventional wiring terminal A conventional wiring terminal 9 is shown in the drawing. The wiring terminal 9 comprises a body 91, a leaf spring 92, and a clamping portion 93.

The body 91 is open in shape and forms a space 911 therein. The clamping portion 93 extends from the body 91 and comprises an upper clamping leaf spring 931 and a lower clamping leaf spring 932. The leaf spring 92 has a substantially L-shaped cross-section and is disposed (by spot welding, for example) inside the space 911 of the body 91.

As shown in the drawing, the conventional wiring terminal 9 does not have sufficient overall structural strength because of the open shape of the body 91. Furthermore, with the wiring terminal 9 being composed of different parts, the overall structure of the wiring terminal 9 is likely to be loose, not to mention that interstices are likely to appear in the wiring terminal 9 during a usage process thereof. Hence, during the usage process of the wiring terminal 9, the clamping force generated by the leaf spring 92 in clamping a transmission line (not shown) is likely to be insufficient and thus results in poor contact to thereby compromise wiring and signal transmission.

BRIEF SUMMARY OF THE INVENTION

A wiring terminal structure of the present invention comprises a box and a plugging element.

The box is an integrally formed unitary unit and comprises an upper wall, two side walls, a lower wall, a hole, and a leaf spring. The upper wall, the two side walls, and the lower wall are connected to each other and circumferentially define a space. The hole is formed on the upper wall and configured for communication between the space and the outside of the box. The leaf spring extends upward from the lower wall to reach the space and form an end. The end protrudes from the hole. The plugging element comprises a plugging portion and a clamping portion. The clamping portion comprises an upper clamping leaf spring and a lower clamping leaf spring which correspond in position to each other.

The plugging portion of the plugging element is inserted into the space and plugged into the box. The end of the leaf spring abuts against the plugging portion and is pressed downward by the plugging portion to lie in the space.

With the box being an integrally formed unitary unit and the leaf spring being corresponding in position to the hole, the wiring terminal structure features enhanced overall structural strength and an enhanced clamping force of the leaf spring.

The plugging portion of the plugging element has a side surface. The side surface is convoluted and forms a plurality of recesses. The end of the leaf spring abuts against one of the recesses. Given the aforesaid design, once the leaf spring clamps a transmission line, the transmissions line will be firmly clamped by the leaf spring.

DETAILED DESCRIPTION OF THE EMBODIMENTS OF THE INVENTION

Figure 1:
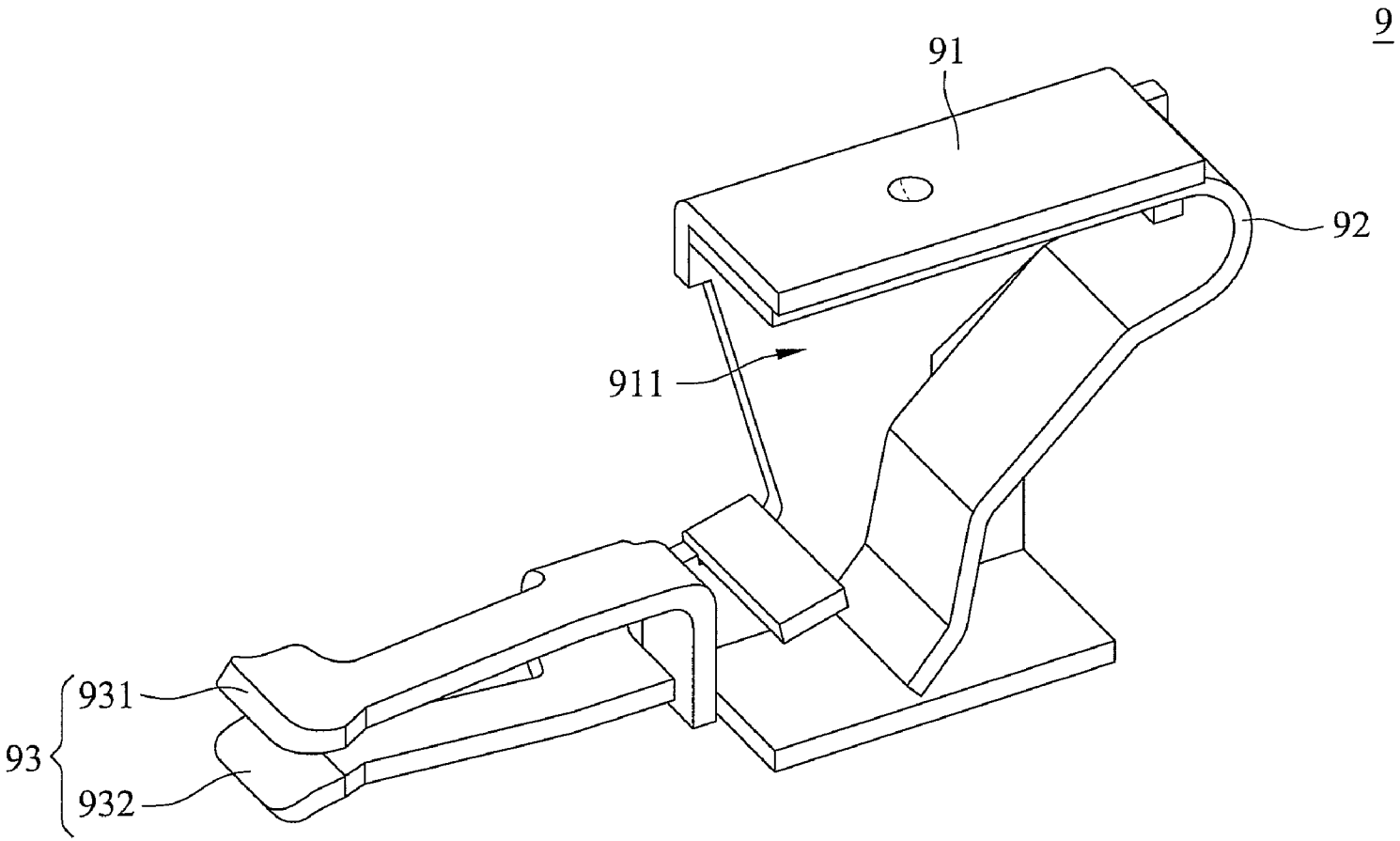
FIG. 1 (PRIOR ART)
FIG. 1 is a perspective view of a conventional wiring terminal.
Figure 2:
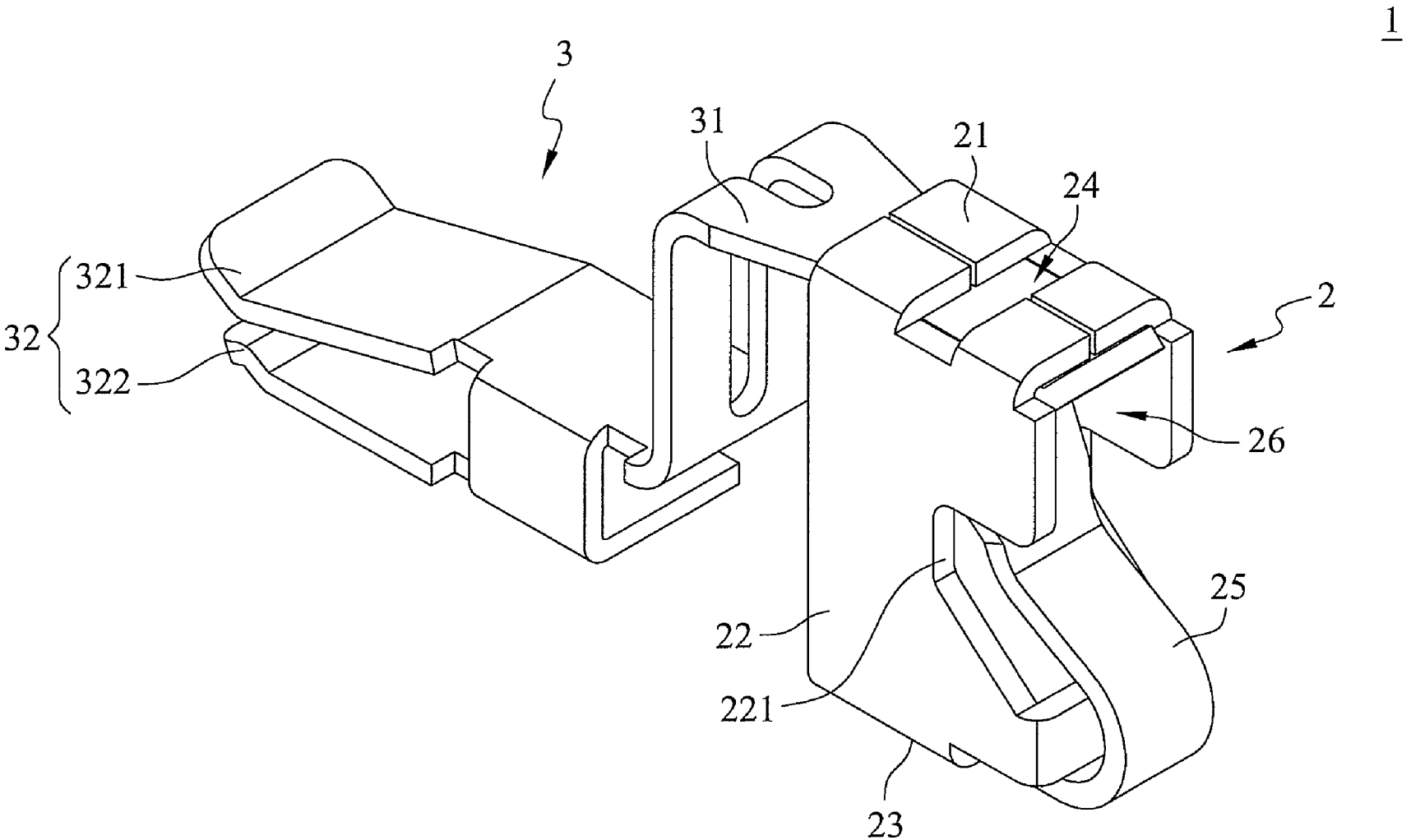
FIG. 2 is a perspective view of a wiring terminal structure according to a preferred embodiment of the present invention.
Figure 3:
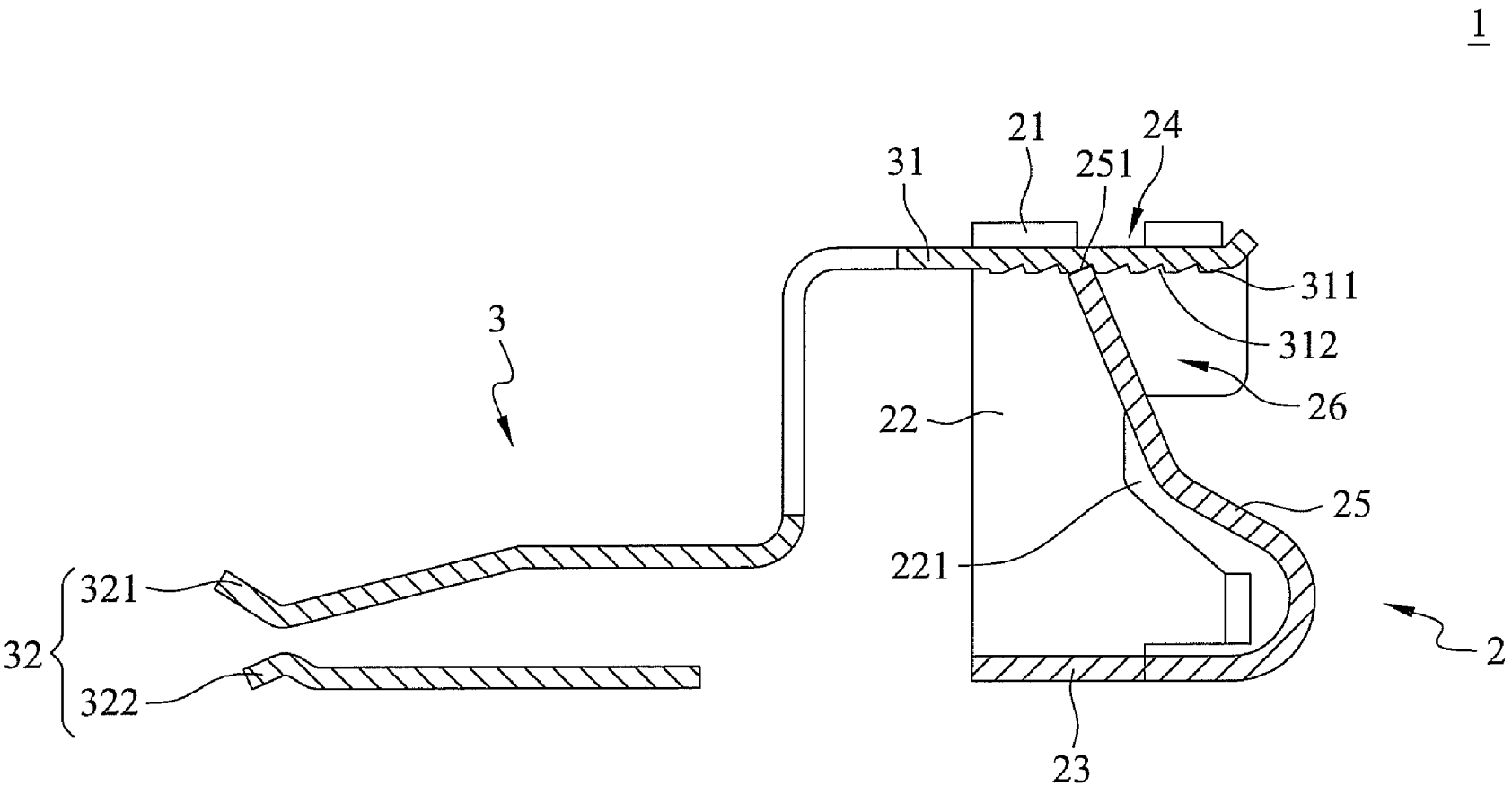
FIG. 3 is a cross-sectional view of FIG. 2.
Figure 4:
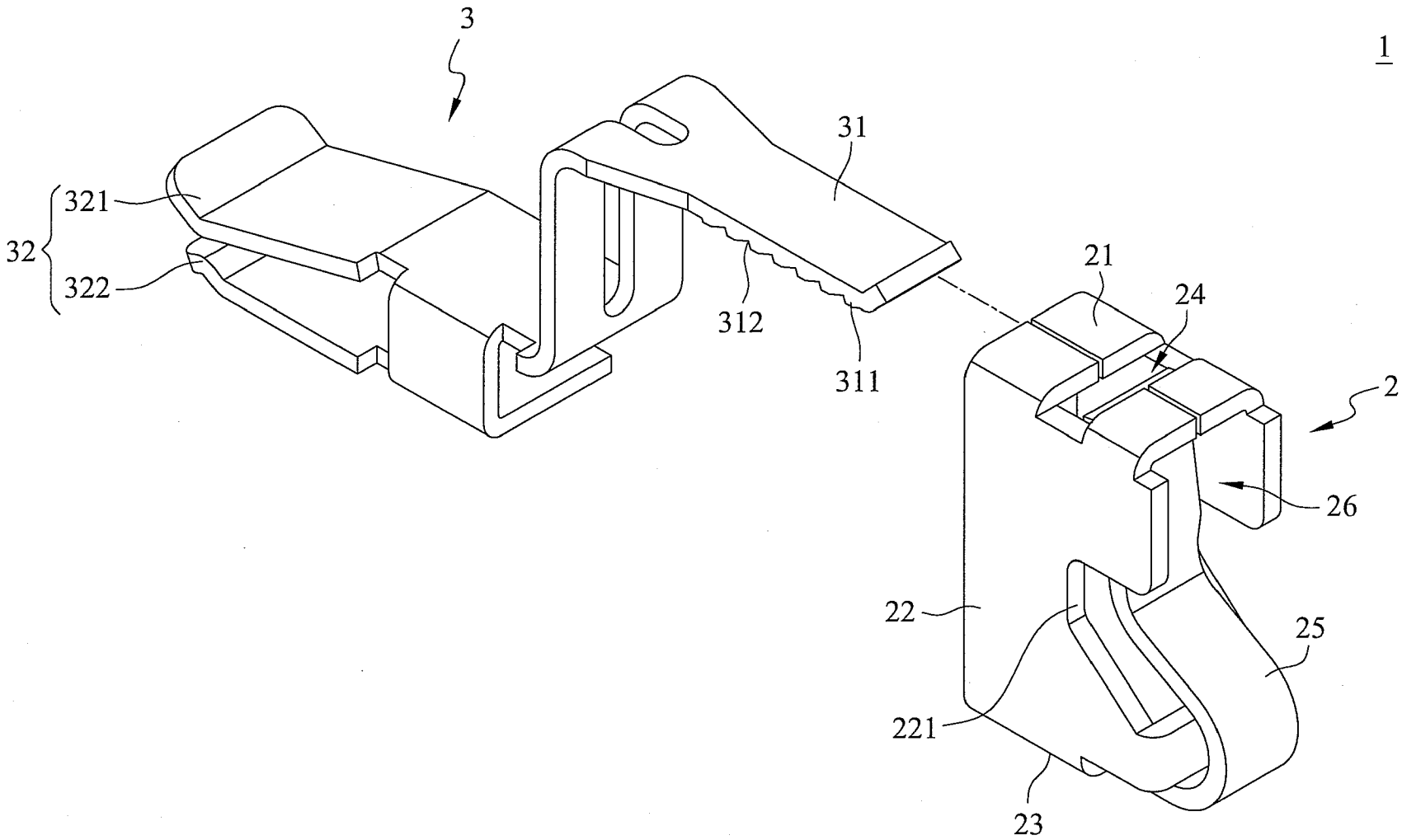
FIG. 4 is an exploded view of a wiring terminal structure according to a preferred embodiment of the present invention.
Figure 5:
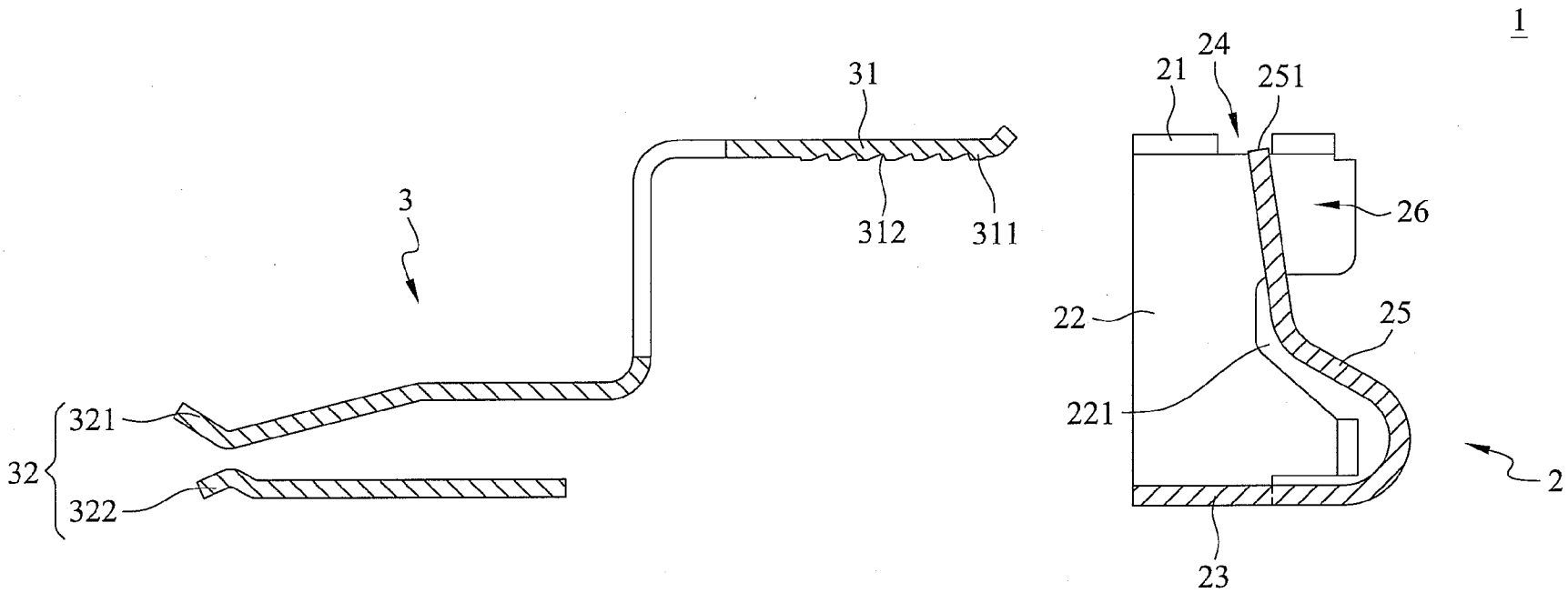
FIG. 5 is a cross-sectional view of FIG. 4.

Please refer to FIG. 2 through FIG. 5. FIG. 2 is a perspective view of a wiring terminal structure according to a preferred embodiment of the present invention. FIG. 3 is a cross-sectional view of FIG. 2. FIG. 4 is an exploded view of a wiring terminal structure according to a preferred embodiment of the present invention. FIG. 5 is a cross-sectional view of FIG. 4.

A wiring terminal structure 1 is shown in the drawings. The wiring terminal structure 1 comprises a box 2 and a plugging element 3.

As shown in the drawings, the box 2 is an integrally formed unitary unit, and comprises an upper wall 21, two side walls 22, a lower wall 23, a hole 24, and a leaf spring 25. The upper wall 21, two side walls 22, and the lower wall 23 are connected to each other and circumferentially define a space 26. The hole 24 is formed on the upper wall 21 and enables communication between the space 26 and the outside of the box 2. The leaf spring 25 extends upward from the lower wall 23 to reach the space 26 and forms an end 251. The end 251 protrudes from the hole 24 (as shown in FIG. 5) formed on the upper wall 21.

In this embodiment, the leaf spring 25 has a substantially S-shaped cross-section. Of course, the leaf spring 25 is bent to assume any other shape, such as L-shaped, as needed.

Also, as shown in the drawings, the plugging element 3 comprises a plugging portion 31 and a clamping portion 32. The clamping portion 32 comprises an upper clamping leaf spring 321 and a lower clamping leaf spring 322 which correspond in position to each other.

The plugging portion 31 of the plugging element 3 is inserted into the spaced 26 of the box 2 and plugged into the box 2. The end 251 of the leaf spring 25 abuts against the plugging portion 31 and is pressed downward by the plugging portion 31 to lie in the space 26 (as shown in FIG. 3).

Figure 6:
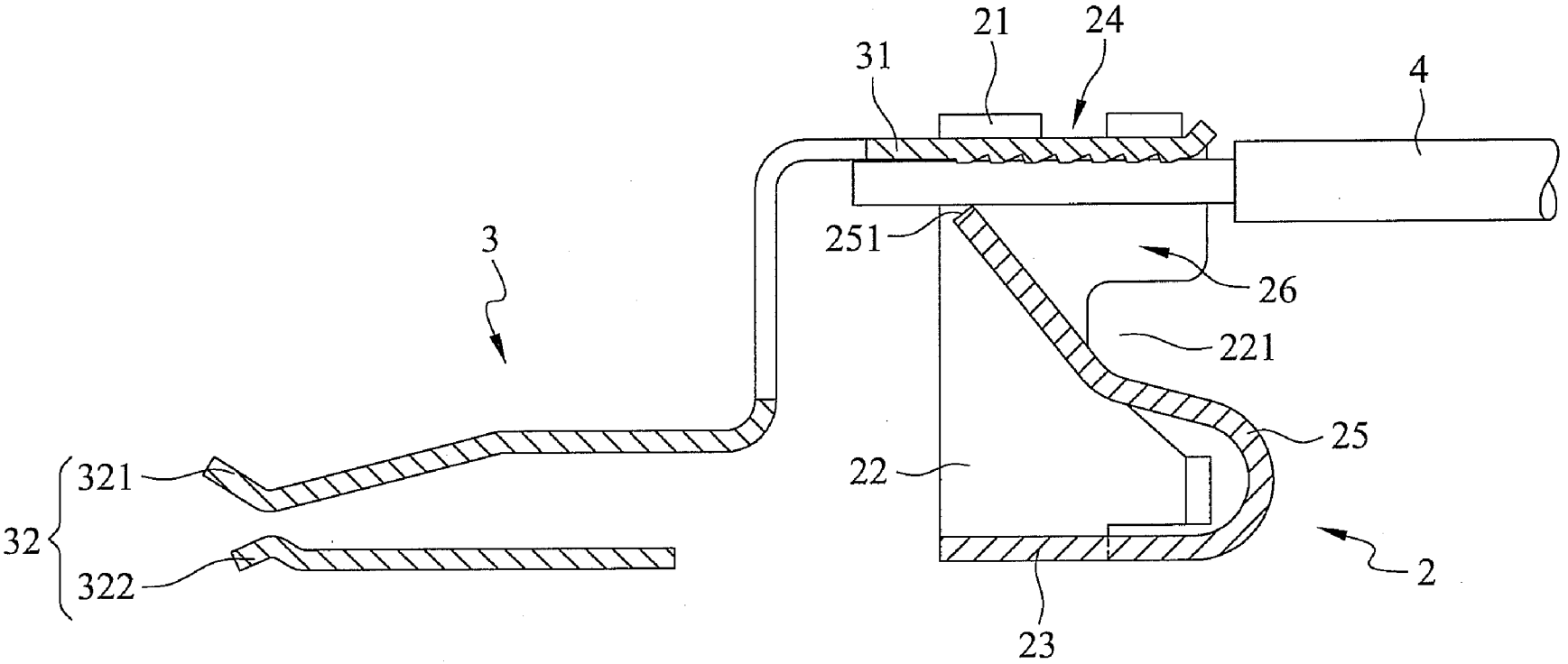
FIG. 6 is a cross-sectional view of the operation state of a wiring terminal structure according to a preferred embodiment of the present invention.

Referring to FIG. 2 through FIG. 6, there is shown in FIG. 6 a cross-sectional view of the operation state of a wiring terminal structure 1 according to a preferred embodiment of the present invention.

As shown in FIG. 6, a transmission line 4 is inserted into the box 2; in other words, in order to be connected, the transmission line 4 pushes the end 251 of the leaf spring 25 into the space 26 of the box 2, and then the transmission line 4 is clamped by the end 251 of the leaf spring 25.

As mentioned above, the end 251 of the leaf spring 25 protrudes from the hole 24 formed on the upper wall 21 of the box 2. Afterward, once the plugging portion 31 of the plugging element 3 is inserted into the space 26 of the box 2 and plugged into the box 2, the end 251 of the leaf spring 25 will abut against the plugging portion 31 and is pressed downward by the plugging portion 31 to lie in the space 26. As a result, the leaf spring 25 generates the so-called surplus; hence, once the transmission line 4 is clamped by the end 251 of the leaf spring 25, the leaf spring 25 will exert an enhanced clamping force and thereby clamp the transmission line 4 firmly.

Furthermore, as describe above, with the box 2 being an integrally formed unitary unit, the overall structure of the wiring terminal structure 1 is reinforced and thus is unlikely to get loose according to the prior art.

In conclusion, with the box 2 being an integrally formed unitary unit and the leaf spring 25 being corresponding in position to the hole 24, the wiring terminal structure 1 features enhanced overall structural strength and an enhanced clamping force of the leaf spring 25.

As shown in the drawings, the plugging portion 31 of the plugging element 3 has a side surface 311. The side surface 311 is convoluted and forms a plurality of recesses 312. The end 251 of the leaf spring 25 abuts against one of the recesses 312. Due to the aforesaid design, once the leaf spring 25 clamps the transmission line 4, the transmission line 4 will be firmly clamped by the leaf spring 25.

As shown in the drawings, a dented portion 221 is concavely disposed on each of two said side walls 22 of the box 2; in doing so, the box 2 dispenses with raw materials when undergoing a manufacturing process. Of course, it is feasible for the dented portion 221 to be concavely disposed on only one of the two said side walls 22.

What is claimed is:

1. A wiring terminal structure, comprising:

a box being an integrally formed unitary unit and comprising an upper wall, two side walls, a lower wall, a hole, and a leaf spring, wherein the upper wall, two said side walls, and the lower wall are connected to each other and circumferentially define a space, the hole being formed on the upper wall and enabling communication between the space and an outside of the box, the leaf spring extending upward from the lower wall to reach the space and forms an end, and the end protruding from the hole; and a plugging element comprising a plugging portion and a clamping portion, the clamping portion comprising an upper clamping leaf spring and a lower clamping leaf spring which correspond in position to each other, wherein the plugging portion is inserted into the space and plugged into the box, and the end of the leaf spring abuts against the plugging portion and is pressed downward by the plugging portion to lie in the space.

2. The wiring terminal structure of claim 1, wherein the plugging portion has a side surface convoluted to form a plurality of recesses, and the end of the leaf spring abuts against one of the recesses.

3. The wiring terminal structure of claim 1, wherein the leaf spring has a substantially S-shaped cross-section.

4. The wiring terminal structure of claim 1, wherein a dented portion is concavely disposed on at least one of two said side walls.

* * * * *